United States Patent [19]

Selwyn

[11] 4,073,587

[45] Feb. 14, 1978

[54] COROTRON APPARATUS

[75] Inventor: Michael Frederick James Selwyn, Lydney, England

[73] Assignee: Rank Xerox Ltd., London, England

[21] Appl. No.: 671,225

[22] Filed: Mar. 26, 1976

[30] Foreign Application Priority Data

Oct. 24, 1975 United Kingdom ..... 43919/75

[51] Int. Cl.[2] ..... G03G 15/00

[52] U.S. Cl. ..... 355/3 CH; 355/15; 361/225

[58] Field of Search ..... 355/3 R, 15, 3 CH; 15/1.5, 94; 250/324–326; 317/262 A; 96/1 C

[56] References Cited

U.S. PATENT DOCUMENTS

| | | | |
|---|---|---|---|
| 3,496,352 | 2/1970 | Jugle | 15/1.5 X |
| 3,870,883 | 3/1975 | Oagley | 317/262 A |
| 3,953,772 | 4/1976 | Zimmer | 15/1.5 X |
| 3,978,379 | 8/1976 | Delvecchio | 317/262 A |

*Primary Examiner*—Richard L. Moses

[57] ABSTRACT

Apparatus for vibrating a corotron wire to prevent contamination including piezoelectric means to vibrate the wire. Also disclosed is an activation arrangement for the wire vibrating means including a striker plate movable with a rotating portion of the machine to periodically vibrate the wire. Additional specific configurations for vibrating means are disclosed.

10 Claims, 8 Drawing Figures

FIG. 2.
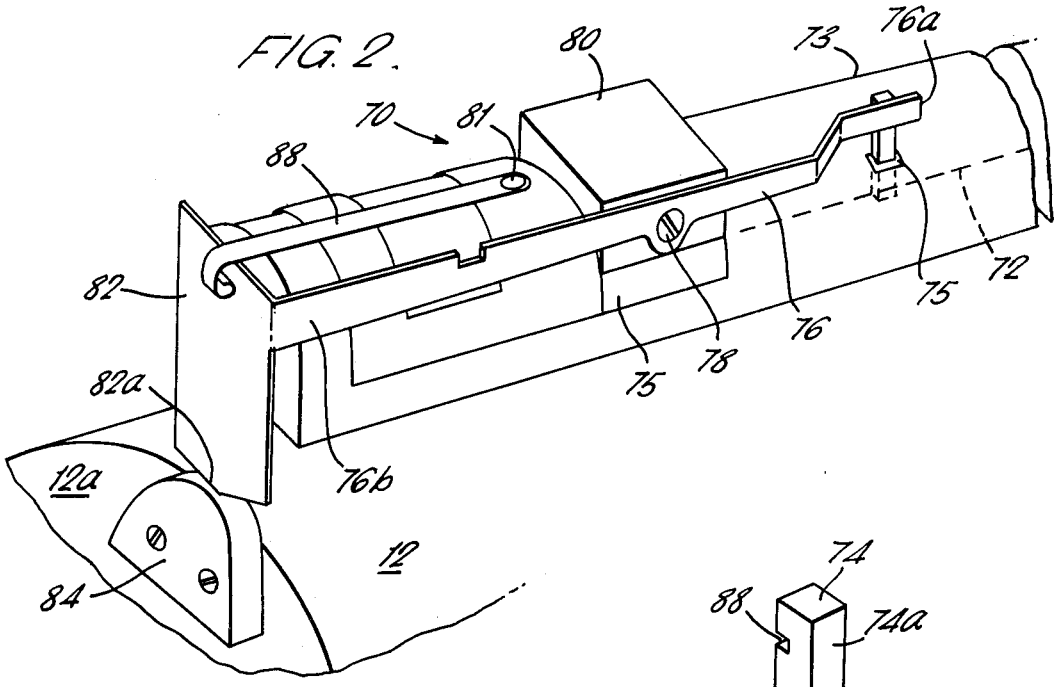
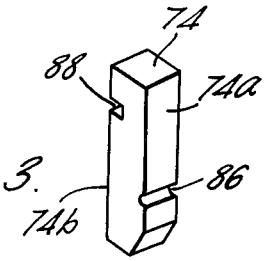
FIG. 3.
FIG. 4.
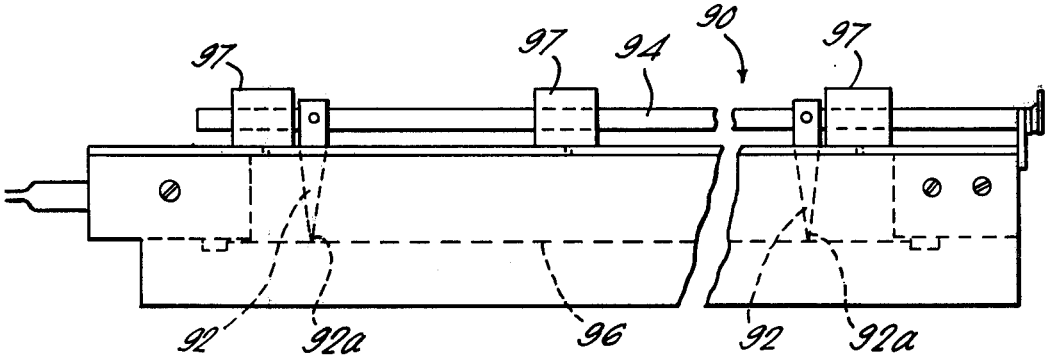
FIG. 5.
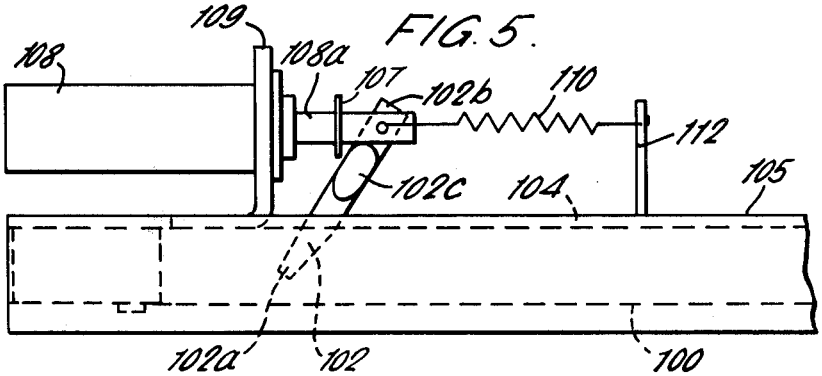

COROTRON APPARATUS

BACKGROUND OF THE INVENTION

This invention relates to xerography and particularly concerns a means and method for cleaning the corotron electrode wires used in xerographic copying machines.

In the process of xerography, as disclosed for example in Carlson U.S. Pat. No. 2,297,691, a xerographic plate comprising a layer of photoconductive insulating material on a conductive backing is given a uniform electric charge over its surface and is then exposed to the subject matter to be reproduced, usually be conventional projection techniques. This exposure discharges the plate areas in accordance with the radiation intensity that reaches them, and thereby creates an electrostatic latent image on or in the photoconductive layer. Development of the latent image is effected with an electrostatically charged, finely-divided material such as an electroscopic powder that is brought into surface contact with the photoconductive layer and is held thereon electrostatically in a pattern corresponding to the electrostatic latent image. Thereafter, the developed xerographic powder image is usually transferred to a support surface to which it may be fixed by any suitable means.

In automatic equipment employing the principles of xerography a plate in the form of a cylindrical drum is continuously rotated through a cycle of sequential operations including charging, exposure, developing and transfer. During the cycle a copy is reproduced onto a support surface and after transfer, the plate is cleaned before re-use. It is usual to charge the xerographic plate with corona of positive polarity on the order of 800–1100 volts by means of corona generating device having an electrode which, when supplied with potential above the corona threshold, produces an emission of corona ions that deposit uniformly onto the plate surface. Typical of the corona generating device employed heretofore are those described in U.S. Pat. No. 2,777,957 and U.S. Pat. No. 2,836,725 which show an electrode wire or wires supported relatively close to the surface to be charged. A grounded metallic shield generally surrounds the electrode except for an opening through which charge is emitted and is adapted to attract surplus emission emanating therefrom.

Inherent in xerographic apparatus of the type described above is the continuous presence of dust generated by the operations and generally comprising particulate quantities of stray electroscopic powder. With prolonged continuous operation, it has been found that the dust accumulates on and about the interior of the corona generator to such an extent that the charging efficiency thereof decreases substantially as the density of dust accumulation increases. This has required frequent cleaning and maintenance. For example, in order to maintain the entire apparatus operating effectively it has been necessary heretofore to completely clean the corona generator after approximately every 20,000 reproductions made. With millions of copies being generated yearly, the cost of servicing has represented a significant economic overhead. At the same time, in order to ensure uninterrupted operation within a plausible programmed maintenance schedule, it has been found necessary to operate these prior corona generating devices at a potential substantially above the threshold potential, being a much higher potential than is otherwise required for corona emission. Still further, in addition to the problem associated with cleanliness it has long been known that the consumption of corona collected by the surrounding shield has been far in excess of that applied onto a recipient surface to be charged. It has been established that with some corona generators the shield or other surrounding elements consume as much as 84% of the total charging current while only the remaining 16% is effective in applying a charge in the manner intended onto a receiving surface such as a xerographic plate.

Although it has been known for some time as shown, for example, by U.S. Pat. No. 2,547,573 and U.S. Pat. No. 3.094,437 that corona generating precipitator electrode wires may be cleaned by intermittently displacing the wire by rapping it or vibrating it, the concept of cleaning a corotron electrode wire of an electrostatic copying machine by causing it to vibrate was not considered apparently because of different conditions under which it operated and the different problems presented, i.e., the possibility of arcing which occurs in copying machines. These differences were recognized by the prior art as shown in U.K. Pat. No. 1,116,687. In that patent, as well as U.K. Pat. No. 1,331,339 the suggested solution is a grounded shield and reduction or prevention of vibration of the wire. Other prior art as shown for example in U.S. Pat. Nos. 2,811,135; 3,842,273; and 3,875,407 suggests mechanical flexing and scraping along the length of the wire while others, for example, disclose replacing the dirty wire (U.S. Pat. No. 3,499,143), vaporising the dirt with periodic high temperature surges (U.S. Pat. No. 3,496,352) and blowing clean air over the wires, (U.S. Pat. No. 3,324,291).

It is a discovery of this invention that periodic controlled vibration of the corotron wire in a copying machine indeed does clean the wire to produce detectable increases in copy quality and in fact does not have the disadvantages such as arcing heretofore associated therewith.

SUMMARY OF THE INVENTION

According to the invention there is provided an apparatus for preventing contamination of a corotron electrode in an electrostatographic copying machine comprising a support means to which the opposite ends of said corotron wire are affixed to hold said wire at a predetermined tension and a vibrator means positioned adjacent said corotron wire operable to vibrate said wire a predetermined amplitude to prevent the accumulation of contaminants thereon.

It is a feature of the invention that the vibrator means is positioned generally adjacent one or both of said opposite ends of said corotron wire.

According to one aspect of the invention the vibrator means includes a movable pick means for plucking said corotron wire. The pick means may:

1. include a finger which intermittently moves linearly generally at right angles toward and into the at-rest position of said wire to displace it; or
2. rotate about an axis generally parallel to said corotron wire and oscillate through an angle or rotation, or rotate generally only in one direction; or
3. pivot generally about an axis transverse to the axis of said corotron wire.

In another aspect of the invention the vibrator means comprises a pair of piezoelectric elements operating on a corotron wire engaging member to vibrate said corotron wire.

In yet another aspect a pair of corotron wires have their ends affixed to an insulating end support which oscillates about an axis parallel to said corotron wires.

According to the invention, there is further provided a method of preventing contamination of a corotron electrode in an electrostatographic machine comprising the steps of holding the corotron wire by its opposite ends under a predetermined tension and vibrating said wire a predetermined amplitude to prevent the accumulation of contaminants thereon.

BRIEF DESCRIPTION OF THE DRAWINGS

The invention will now be described by way of example with reference to the accompanying drawings, in which:

FIG. 2 is a schematic perspective view of a first embodiment of an apparatus for preventing continuation of a corotron electrode;

FIG. 3 is an enlargement of an operating finger portion of the apparatus of FIG. 2;

FIG. 4 is a schematic elevational view of a second embodiment of the invention;

FIG. 5 is a schematic elevational view of a third embodiment of the invention;

DESCRIPTION OF THE PREFERRED EMBODIMENTS

Figure 1:
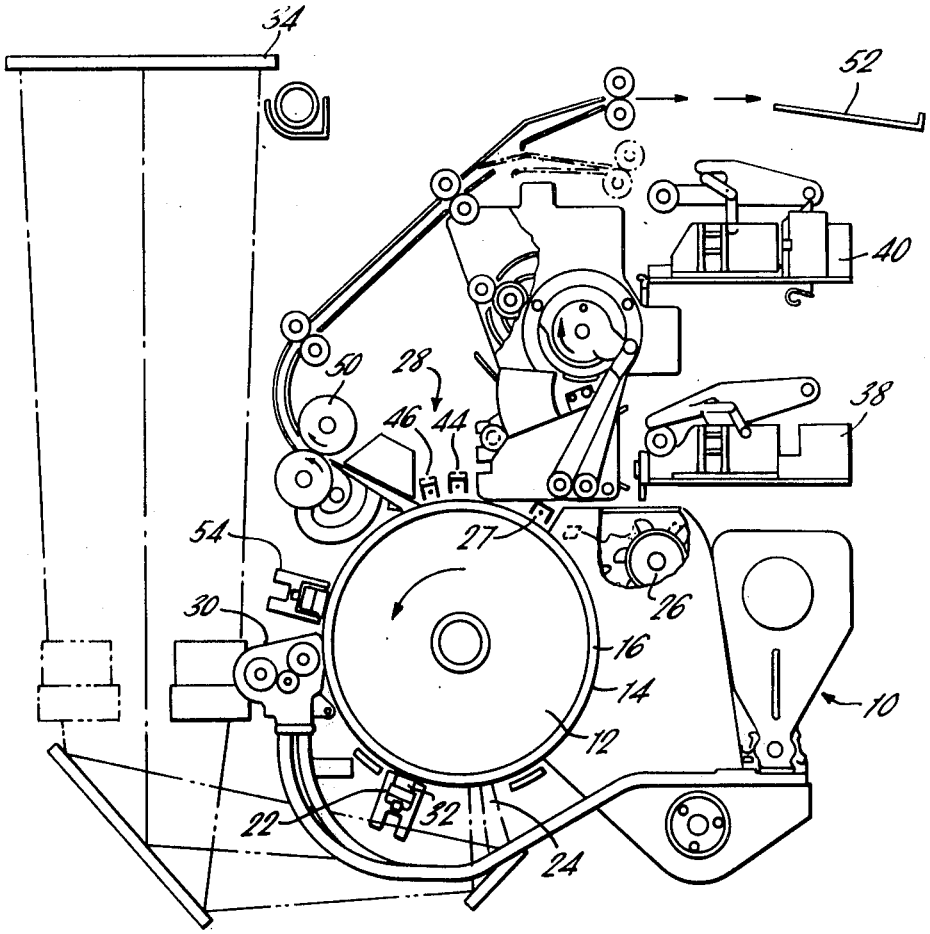
FIG. 1 is a schematic elevational view of an automatic electrostatographic copying machine employing a plurality of corotron electrodes.

The embodiments of the present invention are shown in FIG. 1 in an automatic electrostatographic reproduction machine generally indicated at 10 having a xerographic drum 12 formed of a photoconductive surface 14 placed upon a conductive backing 16. The drum 12 is supported on a shaft 13 and arranged to pass sequentially through a series of processing stations as it is moved in the direction indicated. In order, the processing stations in the path of movement of the drum include a charging station 22, an exposure station 24, a developing station 26, a transfer station 38 and a cleaning station 30.

At the charging station 22 a first corona generating device, known as a charging corotron 32 is arranged across the width of the drum 12 to place a uniform electrostatic charge upon the photoconductive layer 14. This must take place in complete darkness. A flowing light image of an original document supported on a platen 34 is then projected onto the moving drum surface at the exposure station 24 to selectively dissipate the uniform charge thereon thus recording the original input scene information on the photoconductor surface 14 in the form of a latent electrostatic image.

Development of the latent image occurs at the developing station 26 when a two component developer material is cascaded over the image bearing surface 14 whereby toner particles are attracted into the recorded imaged areas thus rendering the images visible.

After the image is developed, the drum passes under a second corona generating device known as a pre-transfer corotron 27 which increases the electrostatic attraction between the drum and the dry toner particles in the background area and reduces the electrostatic attraction between the drum and the image area.

As the drum continues to rotate, a sheet of copy paper 36 from either of trays 38 or 40 passes onto the drum just as the developed image reaches a third corona generating device known as a transfer corotron 44. The transfer corotron 44 places a high positive uniform electrostatic charge on the copy paper 36 which serves to attract a great proportion of the developed image on the drum to the copy paper 36.

The paper and drum next pass under a fourth corona generating device known as a detack corotron 46 which reduces the electrostatic charge holding the copy paper 36 to the drum 12. This action allows the paper to be easily stripped or removed from the drum without disturbing the loose toner powder image on the copy paper 36. The paper then travels to the fuser area 50 where the toner powder is heated and fixed to the copy paper. The paper then passes to an output tray 52 in final form. Meanwhile the drum area from which the paper sheet was stripped passes under a fifth corona generating device known as a pre-clean corotron 54 where the electrostatic charge holding the remaining residual developed image on the drum after transfer is neutralized. The loose particles are removed from the drum at the cleaning station 30 leaving a clean surface 14 to begin the process again.

Referring to FIG. 2, a first embodiment of an apparatus for preventing contamination of a corotron electrode 72 is shown to comprise a vibrator means 70 positioned adjacent to the corotron wire 72 and operable to periodically vibrate the wire a predetermined amplitude to prevent the accumulation of contaminants thereon. An operating finger 74 shown enlarged in FIG. 3 is attached to a first end **76*a* of actuating lever 76 pivotally attached at a generally central point 78 to a relatively fixed support 80. A second end 76*b* has a follower plate 82 attached thereto which is adapted to be contacted on a lower edge 82*a* by a striker plate 84 attached to an end plate 12*a* of the drum 12. The operating finger 74 is made of an insulating material and projects through an opening 75 in a shield 73 above the corotron wire 72. In practice making the finger 74 of Tufnol (trademark) produces good results. A small depression 86 in a first surface 74*a* of the operating finger 74 is adapted to engage with the corotron wire in normal use and transmit to the wire the movement imparted thereto by the actuating lever. Thus, in operation the actuating lever 76 is caused to oscillate about pivot 78 by the impact of the striker plate 84 hitting the lower edge 82*a* of end plate 82. The amplitude of the vibration may be controlled by adjusting the relative impact between striker plate 84 and end plate 82 and this may be done by moving striker plate 84 radially to bring a greater or lesser portion of it into engagement with the end plate 82** on each rotation.

Figure 8:
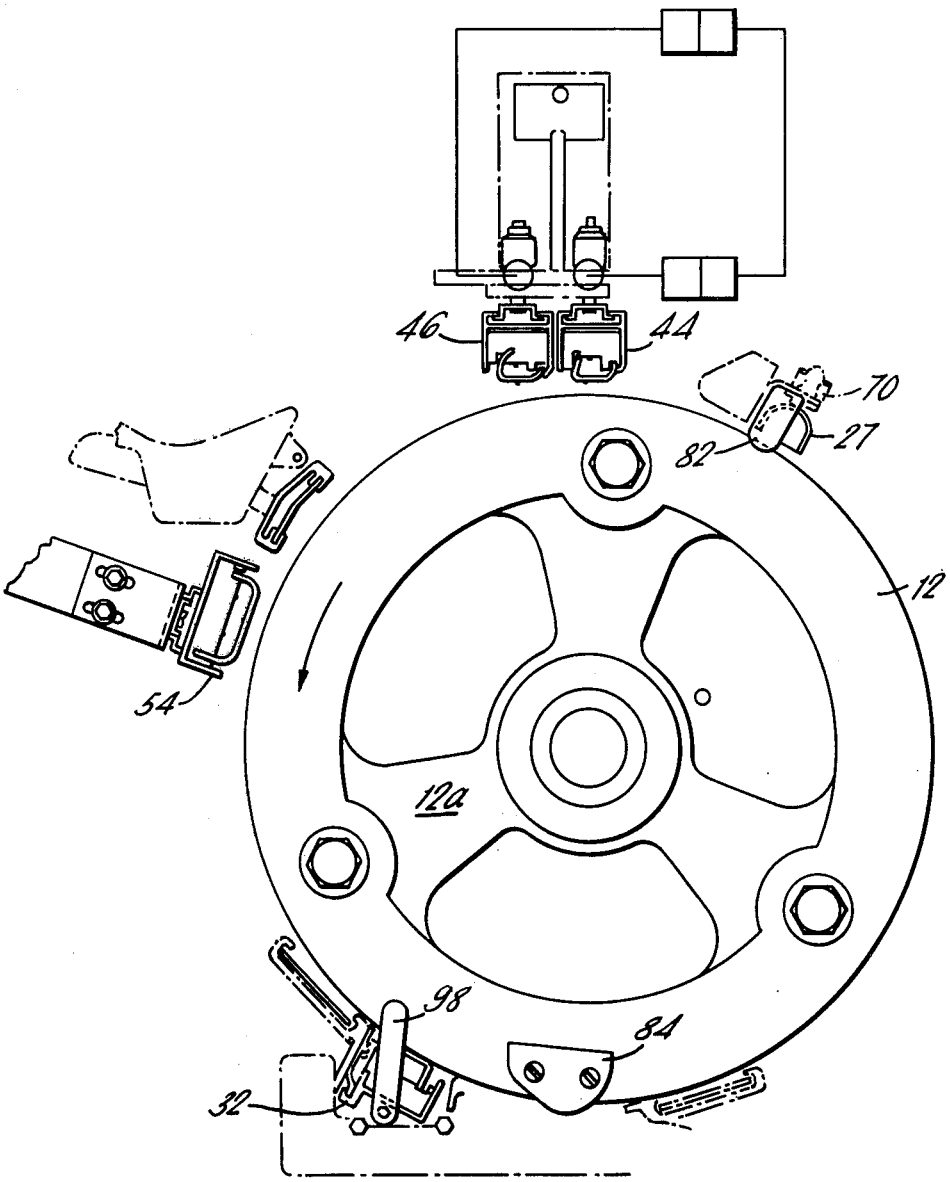
FIG. 8 is an enlargement of a portion of FIG. 1.

A spring member 88 has one end affixed to a point on the vibrator means 70 at 81 and a second engaging the end plate 82 to urge it in a counter-clockwise direction from the point of view of FIG. 1. When the plate 82 is free to pivot as would be the case in FIG. 8 it moves the finger 74 upward out of contact with the corotron wire 72 and when the striker plate 84 hits the plate 82 as suggested in FIG. 2 it sends arm 76 in the other direction to cause finger 75 to move downward and hit the wire 72 to vibrate it. As shown in FIG. 8, this would occur once in every revolution of the drum 12. The wire 72 is anchroed at each end to fixed members 75, 77 which puts the wire under a predetermined tension.

A second embodiment of the invention may be seen in FIG. 4 to comprise a vibration apparatus 90 that includes a pair of plucker members 92 spaced along a shaft 94 and just having their tips 92*a* contacting a corotron wire 96. The shaft 94 extends parallel to the corotron wire 96 through bearing points 97 and has an operating lever 98 affixed to one end. As may be seen in FIG. 8, the lever 98 extends alongside the end of drum 12 in a plane where it will be contacted on each revolution by the striker plate 84. Upon contact, the lever 98 is displaced clockwise approximately 45 degrees as shown in FIG. 8 against the counter bias of a spring means 99. This causes the plucker member 92 to pluck the corotron wire 96 thereby causing it to vibrate. Adjustment of the amplitude of vibration may be effected, assuming constant tension, by changing the length of tip 92*a* in contact with the wire 96 and varying their position along the wire. Both are set to pluck at the same time, however, it is possible to have them pluck at different times during the rotation of shaft 94. In either case, additional pluckers 92 may be provided as required.

In a third embodiment of the invention as shown in FIG. 5, a corotron wire 100 is vibrated by contact with a lower end 102*a* of a lever 102. The lever 102 extends through an elongated slot 104 in a shield 105 partially surrounding the wire 100 and has its upper end 102*b* pivotally connected to a solenoid 108 which reciprocates its plunger 108*a* to the left to bring the lever into contact with wire 100. The solenoid 108 is attached to the shield 105 with a right angle bracket 109. A return spring 110 has one end connected to the upper end 102*b* of lever 102 and its other end connected to a bracket 112 on the shield whereby the upper end 102*b* and an armature 108*a* are biased to the right as shown in FIG. 5. When the solenoid is inactive the return spring 110 removes the vibration lever 102 from contact with the wire 100. The vibration lever 102 has no pivot other than that provided by a shoulder portion 102*c* which is wider than slot 104 and projects from both sides of the lever 102 to sides on the shield 105 around the slot. This arrangement assists the vibrating action and allows the lever to be withdrawn a greater distance from the wire.

In practice we have found that when the solenoid is a DC type but is supplied with an AC half-wave rectified voltage, the effect is to draw the armature 108*a* in until it reaches a rubber stop 107. The return spring 110 pulls it out and hence the armature vibrates in sympathy with the applied half-wave voltage.

Figure 6:
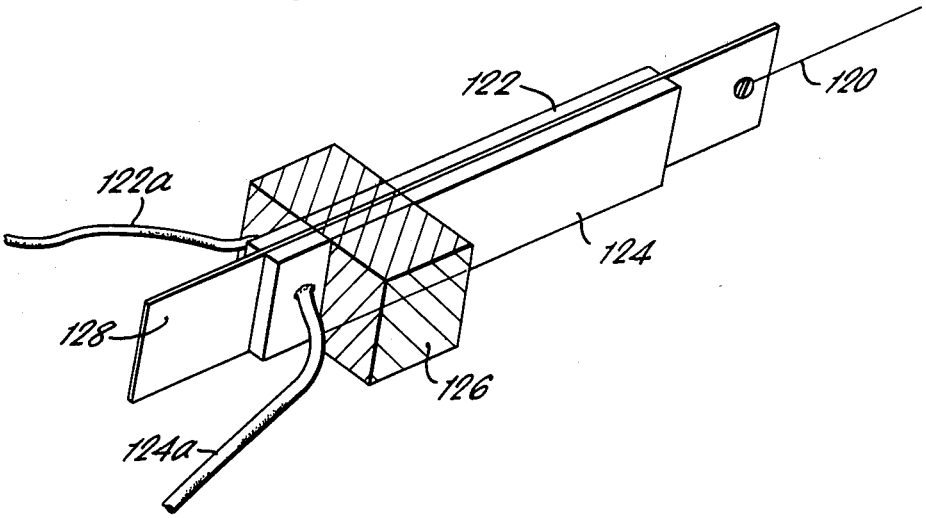
FIG. 6 is a schematic elevational view of a fourth embodiment of the invention.

A fourth embodiment of the invention as illustrated in FIG. 6 utilizes a piezoelectric cermaics and ultrasonic frequencies to vibrate a corotron wire 120 and thereby keep it free of contaminants. Thus, it has been found that a piezoelectric ceramic of the flexure element type can give deflections in the order of 1 to 1.5 mm. In practice the ceramic elements 122, 124 would be for example of a MULLARD (Trademark) PXES or BIMORPH (Trademark) or MULTIMORPH (Trademark) construction and be mounted on opposite sides of a metal strip 128 in a cantilevered fashion as shown held by a clamp 126. The strip 128 provides a high voltage input terminal for the corotron wire 120. Each element 122, 124 has electrical leads 122*a*, 124*a*, respectively, connected with a source of electricity and when a voltage of one polarity is applied to the ceramic elements, one element e.g., 122 will get longer due to poling and the other element e.g., 124 will get shorter. Reversing the polarity of the applied voltage reverses the direction change of the elements. Hence, when elements 112, 124 are bonded to the strip 128 the end of the strip to which the corotron wire 120 is attached will deflect first in one direction and then in the other as the polarity is changed. This will vibrate the corotron wire. The frequency of the deflections is dependent upon the frequency of the applied pulse or AC voltage and the greatest deflections will occur at the resonant frequency of the ceramic element. Amplitude will be easily and accurately varied by the frequency and voltage applied.

Figure 7:
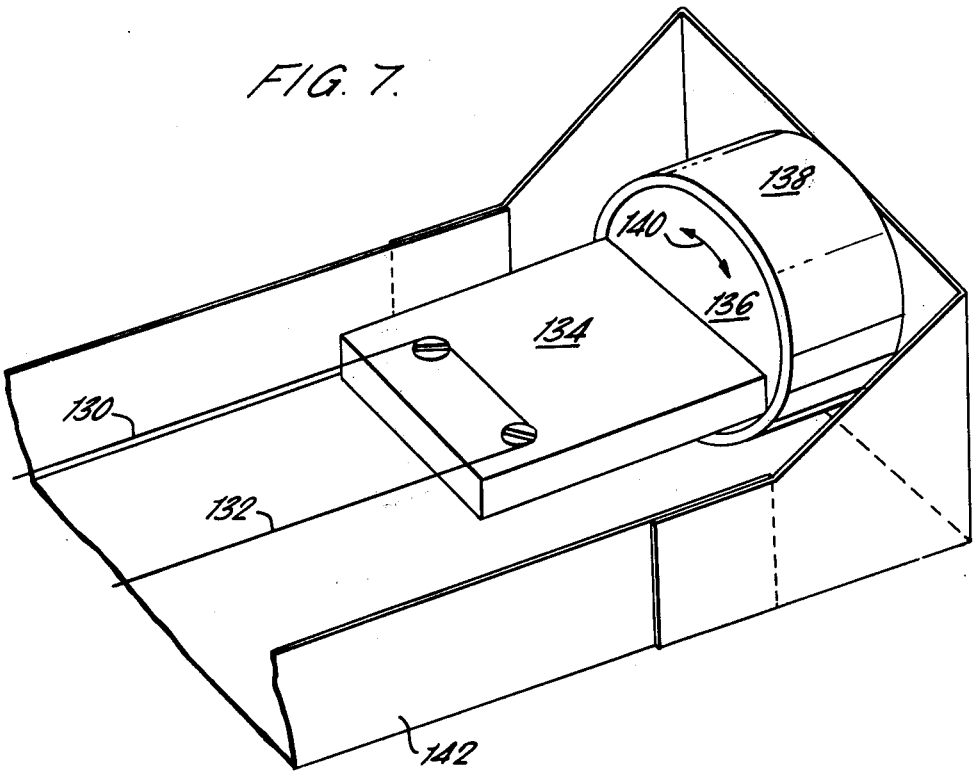
FIG. 7 is a schematic perspective view of a fifth embodiment of the invention.

In the fifth embodiment of the invention shown in FIG. 7 a pair of corotron wires 130, 132 each having an end 130*a*, 132*a*, mounted on an insulating block 134 may be vibrated by fastening the block 134 to the face plate 136 of a rotary solenoid 138. The rotary solenoid is a DC type and when supplied with an AC voltage half-wave rectified, results in vibrating action indicated by the arrows 140 which is transmitted through the block 134 to the corotron wires 130, 132. The solenoid in turn is fixed to a partially surrounding shield 142.

In addition to the five illustrated embodiments of the means for vibrating a corotron wire many other variations are contemplated. For example, the corotron wires may be vibrated by a bowing action such as is used in stringed instruments. Thus, a rotating member of a circular or oval configuration placed no further away than the longest radii of that member will either continuously or intermittently rotate to abrade against the wire cuasing it to vibrate. Alternatively, the rotating member may be generally circular with spaced raised portions such as teeth that intermittently engage the wire to pluck it as the member rotates. A Geneva motion may be used to rotate the member. Providing a plurality of wire engaging vibrating members at points along the wire which are not the node or antinode points of the other members prevents a built up of contaminants at the nodes or antinodes and hence leads to a cleaner wire.

In another variation not shown an insulating rod is guided through and between holes in the shield walls while a fine hole in the rod permits the corotron wire to pass through it. To vibrate the wire in this case it is only necessary to apply an oscillating means to the portion of the rod which protrudes from the shield. The oscillating means may be electrical, mechanical or combinations thereof. For example, a piezoelectric means or transducer could be used. Such transducers can be fed with signals of chosen frequency to cause the corotron wire to resonate as and when required. For scorotrons, similar means may be coupled to the screen wires and to the coronode can be used to couple the wires to a selectively vibrating source.

It will be noted that with the embodiments disclosed herein a regular contacting and vibrating of the corotron wires will occur of a frequency such that standing waves, which have occurred in corotron wires in the prior art, are effectively dampened. The actual frequency of vibration or vibration-generating impact to the wire will vary. Thus, in the machine 10 as shown in FIGS. 1 and 8 the mechanically cleaned corotrons 32 and 27 receive a vibration generating impact every revolution of the drum. Other electrically energized corotron vibrating means may be energized at other intervals as for example, continuously, after each series of copies are made, or at other convenient times.

From the examples of FIGS. 2 to 5, it may be seen that the means for causing vibration includes a movable picktype means which may be said to pluck the corotron wire. Here, the actual activation is caused by movement generally normal to the wire, FIG. 2; about an axis parallel to the wire, FIG. 4; and about an axis transverse to the wire, FIG. 5. In addition, bowing action against the wire is disclosed. Vibratory twisting of the wire is also contemplated.

In each of the foregoing embodiments of vibrator means the opposite ends of a corotron wire or wires is held on a support member so that a predetermined tension, for example, in the range of 15 to 20 ounces, may be applied thereto. Moreover, it is a feature of each that the amplitude of vibration may be predetermined and set or controlled to provide a range of, for example, 1.0 to 1.5 mm on each side of the rest position. The corotron wires may be of any suitable wire such as tungsten and platinum.

It is an aim of the invention to maintain the corotron wires as clean as when new by preventing contamination. However, it is recognized that in some situations contaminants may already be present or build up for reasons which cannot be prevented by vibration and in these instances it becomes an object of the invention to dislodge the build up or limit it to a small value.

Many factors will dictate which of the many embodiments may be used in a specific situation. In the machine 10 of FIGS. 1 and 8, restrictions on space proved a deciding factor and hence various embodiments lent themselves best to meeting the different space requirements. For example, in practice it was found that the first embodiment of FIGS. 2 and 3 fit the available space for the pre-transfer corotron 27. The second embodiment of FIG. 4 met the space limitations of the charge corotron 32 whereas the configuration of FIG. 5 served best for the transfer and detach corotrons 44, 46 respectively. For the pre-clean corotron 54, the embodiment of FIG. 7 was the best design. A point to be made is that although all disclosed embodiments function to vibrate a corotron wire, each has features and advantages which make it best for different situations.

While we have described and illustrated herein a number of embodiments of the invention, it will be apparent to those skilled in the art that changes and modifications may be made thereto without departing from the spirit and intent of the invention which is limited only to scope of the appended claims.

What is claimed is:

1. An apparatus for preventing contamination of a corotron electrode in an electrostatographic copying machine comprising a support means to which the opposite ends of said corotron wire are affixed to hold said wire at a predetermined tension, vibration means positioned adjacent said corotron wire operable to vibrate said wire a predetermined amplitude to prevent the accumulation of contaminants thereon, and means for activating said vibration means periodically in response to the movement of a rotating portion of said electrostatographic machine, said vibration means including a pick means connected to a shaft generally parallel to said corotron wire, said shaft having a follower surface connected thereto, said follower surface being positioned to be struck and oscillated by a striker plate connected to a rotating portion of said electrostatographic machine.

2. An apparatus according to claim 1 wherein said pick means rotates about an axis generally parallel to said corotron wire.

3. An apparatus according to claim 1 wherein said striker plate is attached to an end of a photoreceptor drum.

4. An apparatus according to claim 1 wherein said pick means pivots generally about an axis transverse to the axis of said corotron wire.

5. An apparatus for preventing contamination of a corotron electrode in an electrostatographic copying machine comprising a support means to which the opposite ends of said corotron wire are affixed to hold said wire at a predetermined tension and a vibrator means positioned adjacent said corotron wire operable to vibrate said wire a predetermined amplitude to prevent the accumulation of contaminants thereon, said vibration means comprising a piezoelectric means operating on a corotron wire engaging member to vibrate said wire.

6. An apparatus according to claim 5 wherein said piezoelectric means comprises a pair of piezoelectric elements attached to opposite sides of a metallic end support strip to which said corotron wire is connected and through which receives its electrical energy.

7. An apparatus for preventing contamination of a corotron electrode in an electrostatographic copying machine comprising a support means to which the opposite ends of said corotron wire are affixed to hold said wire at a predetermined tension and a vibrator means positioned adjacent said corotron wire operable to vibrate said wire a predetermined amplitude to prevent the accumulation of contaminants thereon, said vibrator means comprising a finger attached to one end of a pivot arm, said pivot arm having a follower surface on the opposite side of the arm pivot point, said follower surface being positioned to be struck and oscillated by a striker plate connected to a rotating portion of said electrostatographic machine.

8. An apparatus according to claim 7 wherein said finger is elongated and includes a notch in a side thereof which notch intermittently receives said wire therein.

9. An apparatus for preventing contamination of a corotron electrode in an electrostatographic copying machine comprising a support means to which the opposite ends of said corotron wire are affixed to hold said wire at a predetermined tension and a vibrator means positioned adjacent said corotron wire operable to vibrate said wire a predetermined amplitude to prevent the accumulation of contaminants thereon, said vibrator means including movable pick means for plucking said corotron wire, said pick means including a finger having one end attached to a reciprocating member and having an opposite end extending through a slot in a shield about said corotron wire, said member having a shoulder restraining said finger from passing through said slot.

10. An apparatus according to claim 9 wherein said reciprocating member is an armature of a DC type solenoid, adapted to be supplied with half-wave rectified AC voltage.

* * * * *